US005674161A

United States Patent [19]

Lin

[11] Patent Number: 5,674,161

[45] Date of Patent: Oct. 7, 1997

[54] EXERCISER UTILIZING A USER'S OWN WEIGHT AS A LOAD

[76] Inventor: Wen-Ken Lin, 6F, No. 5-1, Lane 170, Hsingyi Road, Peito, Taipei, Taiwan

[21] Appl. No.: 729,151

[22] Filed: Oct. 11, 1996

[51] Int. Cl.[6] ..... A63B 69/06; A63B 21/00

[52] U.S. Cl. ..... 482/96; 482/72

[58] Field of Search ..... 482/57, 95, 96, 482/72

[56] References Cited

U.S. PATENT DOCUMENTS

| | | | |
|---|---|---|---|
| 5,356,357 | 10/1994 | Wang | 482/57 X |
| 5,458,553 | 10/1995 | Wu | 482/95 |
| 5,507,710 | 4/1996 | Chen | 482/95 X |
| 5,527,243 | 6/1996 | Chen | 482/57 X |
| 5,569,132 | 10/1996 | Wu | 482/72 X |
| 5,582,562 | 12/1996 | Wang | 482/72 X |
| 5,591,108 | 1/1997 | Chen | 482/57 X |

*Primary Examiner*—Jerome Donnelly
*Assistant Examiner*—William LaMarca
*Attorney, Agent, or Firm*—Bacon & Thomas

[57] ABSTRACT

Disclosed is an exerciser utilizing a user's own weight as a load on the exerciser for the user to overcome by applying force on a handle bar or two foot rests of the exerciser and lifting the user's body seated on a seat holder of the exerciser.

1 Claim, 4 Drawing Sheets

EXERCISER UTILIZING A USER'S OWN WEIGHT AS A LOAD

BACKGROUND OF THE INVENTION

There are various types of indoor exercisers for fitness purpose widely welcomed by the general consumers. Every type of exercisers have their own specific functions because they are designed to train one or more part of a user's body. To permit the same exerciser to provide adjustable loads to meet different needs of different users, most of the exercisers are equipped with different means as loads, such as weights, elastic belts, or oil cylinders. Exercisers with such means for loads usually have rather complicate structure, and therefore occupy larger room and require higher manufacturing cost.

SUMMARY OF THE INVENTION

A primary object of the present invention is to provide an exerciser which utilizes a user's own weight as a load in training the user's muscles without using other external means for loads and, therefore, has simplified structure while achieves the same good training effect.

The exerciser according to the present invention mainly includes a reversed V-shaped support, a pull member and a handle bar pivotally connected to a top of the support, two foot rests and a seat holder provided at a middle portion of the support, and links separately pivotally connecting the seat holder to the pull member and the foot rests. All the components of the exerciser are pivotally connected to enable necessary leverage at suitable points on the exerciser. When a user sits on the seat, his or her own weight forms a downward load against which the user may use two hands or two feet to operate the pull member or the foot rests to overcome and thereby lift and then lower him or her self on the exerciser.

DETAILED DESCRIPTION OF THE PREFERRED EMBODIMENT

Figure 1:
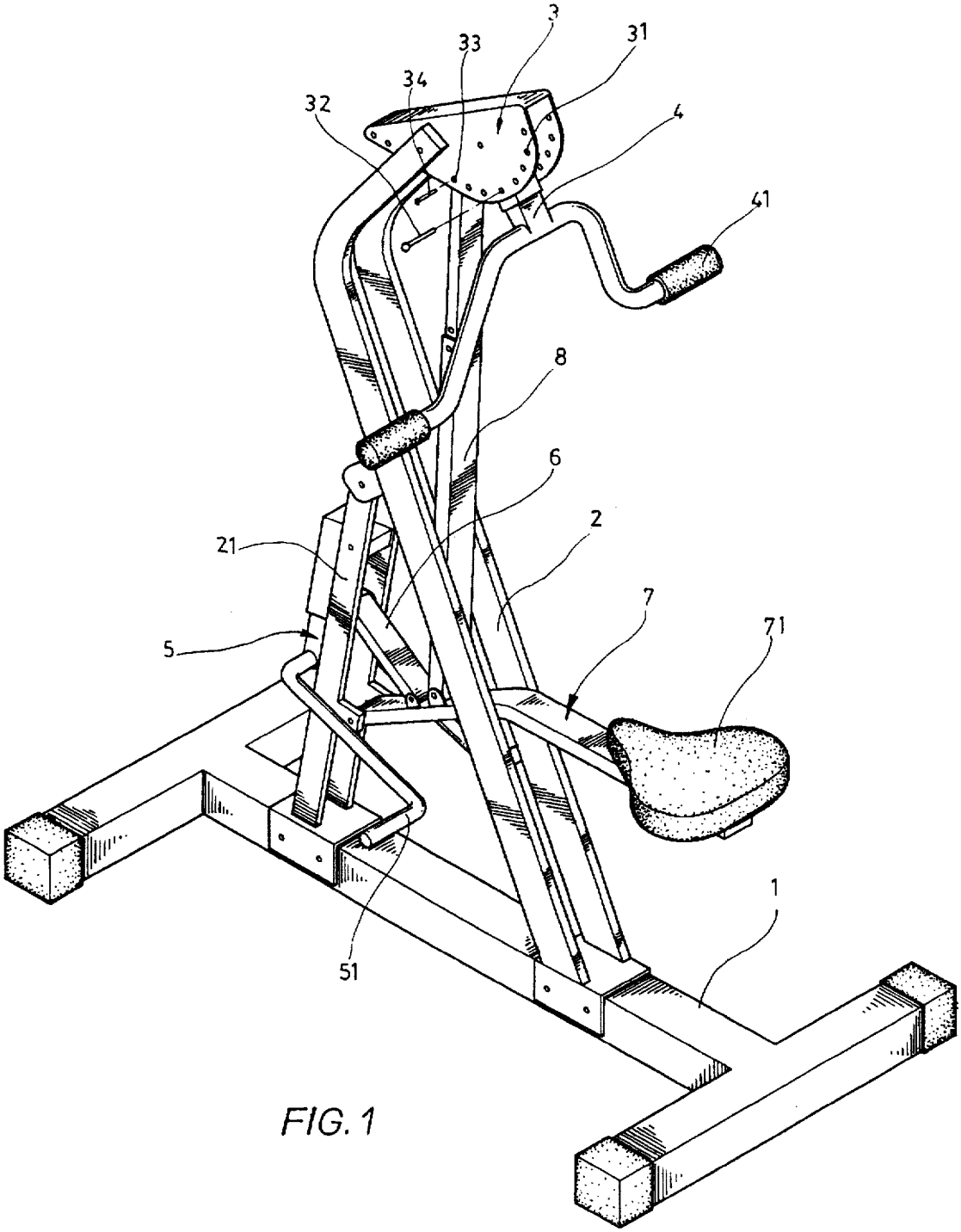
FIG. 1 is a perspective of the exerciser according to the present invention.

Please refer to FIG. 1. The present invention relates to an exerciser which mainly includes:

a base frame 1;

a main and a secondary supports 2, 21 each including two parallel and spaced members inclinedly extending upward and toward each other from the base frame 1 with a top of the secondary support connected to a middle portion of the main support 2;

a pull member 3 including two parallel and spaced side galls and pivotally connected to and tamable about a top of the main support 2 between the two parallel members thereof; a plurality of adjusting hole pairs 31 being formed along a part of lower periphery of the two side walls of the pull member 3 for matched locking pins 32 to thread therethrough:

a handle bar 4 fixedly but adjustably connected to and between two side walls of the pull member 3 by the locking pins 31 threaded through one of the adjusting hole pairs 31, so that the handle bar 4 can be angularly fixed to a desired position selected by the user; a plurality of shift hole pairs 33 and matched locking pins 34 being provided to the other part of the lower periphery of the pull member 3 for connecting a long link 8 which will be described later; the handle bar 4 further having two angularly outward extended grip portions 41 in a formation most suitable for gripping by a user;

a foot rest support 5 mounted to a front of the secondary support 21 with two foot rests 51 angularly extending sideward and backward therefrom at a suitable angle for the user to push forward;

a backward and upward extended seat holder 7 having a front end pivotally connected to a lower portion of the secondary support 21 and a rear end with a seat 71 connected thereto;

short link 6 having an upper end extending into two parallel members of the secondary support 21 and pivotally connected to a back middle portion of the foot rest support 5, and a lower end pivotally connected to a front portion of the seat holder 7; with the short link 6, a rear portion of the seat holer 7 and the seat 71 being supported in a suspended state and the foot rest support S pressing against the secondary support 21; a rubber pad being provided on the foot rest support S at a surface contacting with the secondary support 21 to minimize noise produced when the foot rest support 5 impacting on the secondary support 21; and a long link 8 extending between two parallel members of the main support 2 and having a lower end pivotally connected to the front portion of the seat holder 7 a little behind the short link 6 and an upper end extending into and pivotally connected to the two side walls of the pull member 3 at a pair of adjusting boles 31 formed on the side walls, whereby the seat holder 7 changes its position with the movement of the pull member 3.

An adequate distance is left between the shift hole pairs 33 connecting with the long link 8 and the adjacent adjusting hole pairs 31, as well as between the shift hole pairs 33 connecting with the long link 8 and a shaft connecting the top of the main support 2 to the pull member 3. When the pull member 3 is turned about the shaft relative to the main support 2, it causes the long link 8 connected thereto by the shift hole pairs 33 and locking pins 34 as well as the seat holder 7 pivotally connected to the lower end of the long link 8 to shift at the same time. In other words, the handle bar 4, the foot rest support 5, the seat holder 7, and the links 6, 8 together form a group of linkage between the main and the secondary supports 2, 21 due to torques and leverage established among these components. With this group of linkage, the user may operate the exerciser of the present invention to achieve the projected training and fitting purpose.

Figure 2:
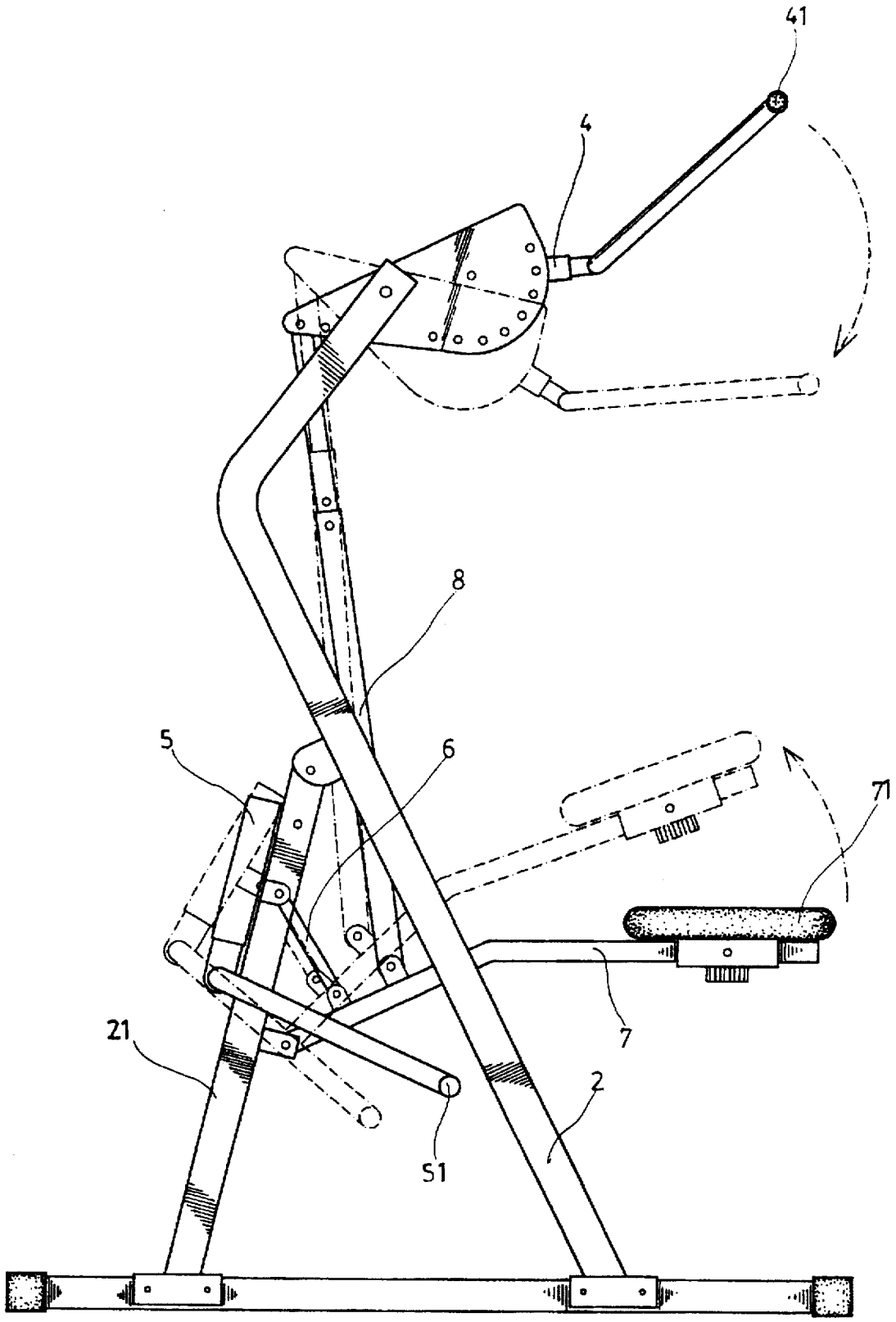
FIG. 2 is a side elevational view showing the operation of the foot rests of the present invention to lift the seat holder and therefore the user sitting on the seat.

As shown in FIG. 2, the present invention can be operated from the foot rest support 5. When the user sits on the seat 71, he or she self forms a load on the exerciser and pushes the seat holder 7 downward. At this point, the user may apply force on the foot rests 51 to push the same forward. This will cause the seat holder 7 connected to the foot rest support 5 via the short link 6 to be lifted at the end with the seat 71. The user's weight on the seat 71 itself forms a load to the user's feet applying force on the foot rests 51 and therefore, the push of the foot rests 51 with two feet to lift the seat holder 7 has an effect to train the user's legs. In operating the exerciser with two feet, the handle Bar 4 is used only for gripping.

Figure 3:
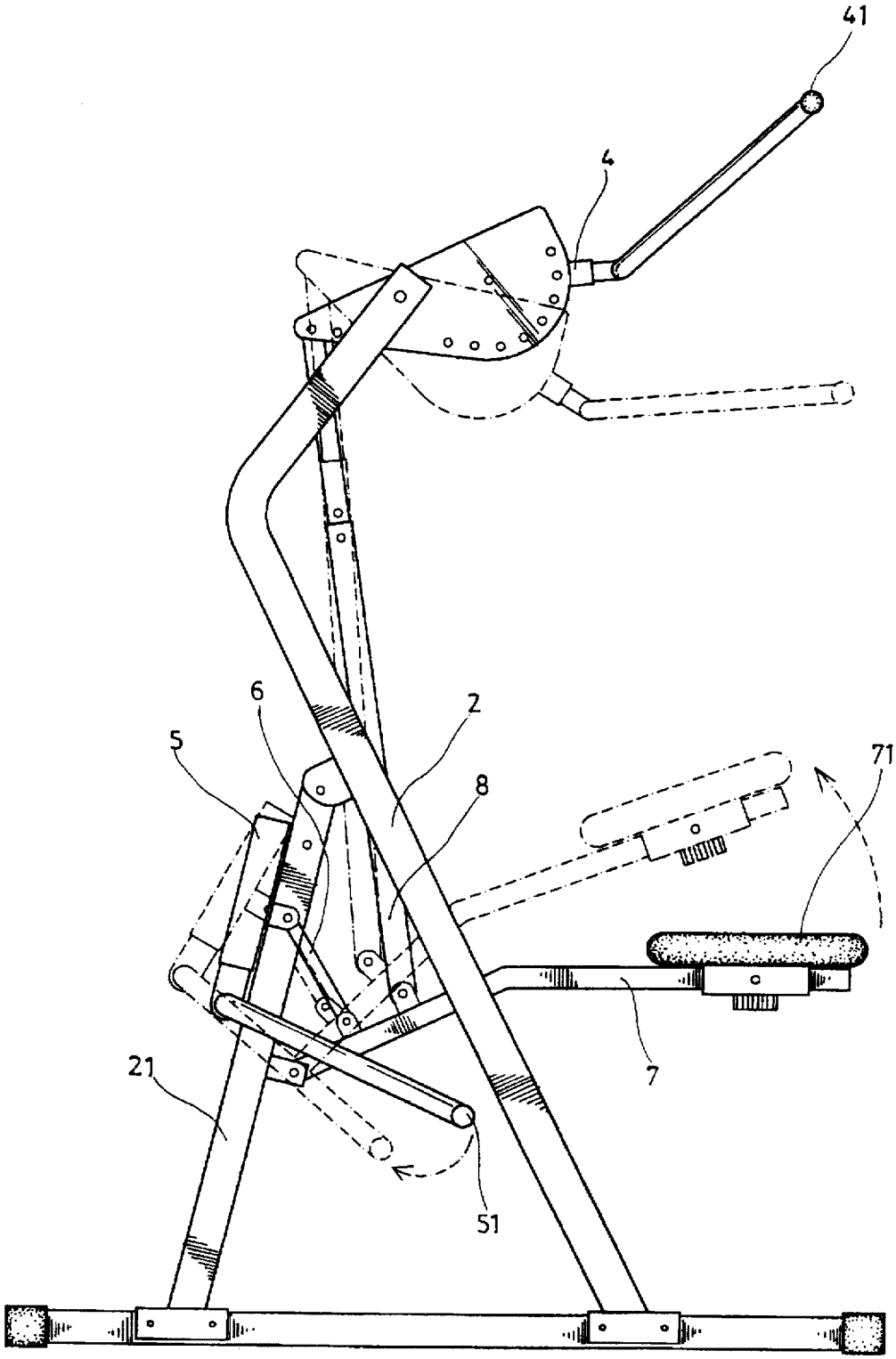
FIG. 3 is a side elevational view showing the operation of the handle bar of the present invention to lift the seat holder and therefore the user sitting on the seat.
Figure 4:
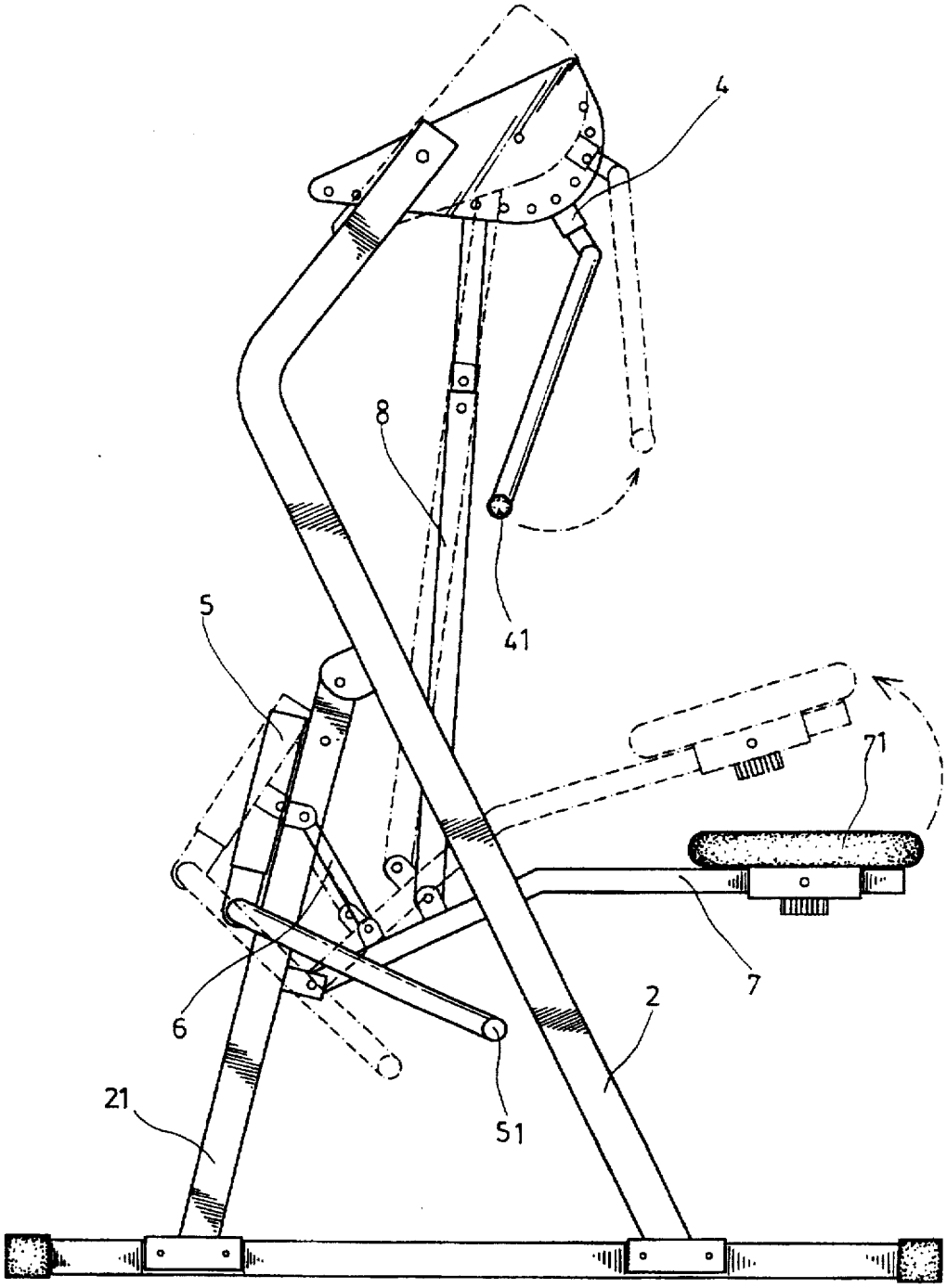
FIG. 4 is another side elevational view showing another way of operating the handle bar of the present invention.

FIG. 3 shows the present invention is operated from the handle bar 4. When the user sits on the seat 71 and forms a load on the exerciser, he or she may firmly hold the grip portions 41 and pull the same downward. With the long link 8 extending between the pull member 3 and the seat holder 7, the seat holer 7 is lifted at the seat end when the handle bar 4 is pulled downward. And, when the handle bar 4 is released, the seat holder 7 is allowed to move down again. Repeated pulling and releasing of the handle bar 4 permits the user to train his or her muscles at different areas. The handle bar 4 can be adjusted in its height relative to the seat holder 7 by selecting a suitable adjusting hole pair 31 and fixing the handle bar 7 thereto by the locking pin 32. In operating the exerciser with two hands, the foot rest support 5 and the foot rests 51 are used only as a means for the feet to rest FIG. 4 illustrates another manner to operate the exerciser with the handle bar 4. In this operating manner, the handle bar 4 is turned upside down before it is connected to the pull member 3. Since the pull member 3 is pivotally connected to the top of the main support 2 by means of the shaft and secured to the long link 8 at the shift hole pairs 33 by means of the locking pin 34, the application of force on the handle bar 4 to operate the exerciser and the effect of the exerciser in training the user's muscles is not affected by the reverse position in which the handle bar 4 is connected to the pull member 3 as shown in FIG. 4. The user may still sit on the seat 71 and pulls the handle bar 4 toward himself or herself with two hand gripping at the grip portions 41. By repeatedly pulling the handle bar 4 backward and then releasing the same, good training effect can be achieved with the exercise of the present invention.

To facilitate delivery of the exerciser of the present invention to a consumer in a safe and economical manner, the exerciser is designed to have a foldable or collapsible structure so that it can be folded to a small volume for packing. That is, almost all components of the exerciser are connected at their joints by means of screws or pins. Since this can be achieved by prior art and is therefore not further discussed herein.

What is claimed is:

1. An exerciser utilizing a user's own weight as a load, comprising:

a main support and a secondary support both including two parallel and spaced members;

a pull member including two parallel and spaced side walls and being pivotally connected to and between a top of said two parallel and spaced members of said main support by means of a shaft, said pull member being provided on said two side walls at a lower periphery with a plurality of adjusting hole pairs for a matched locking pin to thread through:

a handle bar having an end fixedly connected to and between said two side walls of said pull member and two grip portions outward and angularly extended from another end of said handle bar; said handle bar being connected to said pull member by threading a locking pin through a pair of desired adjusting holes formed on said side walls of said pull members and on said handle bar, such that said handle bar can Be adjusted in its angular position relative to said pull member;

a seat holder having a downward inclined front portion pivotally connected to said secondary support and a substantially horizontally extended rear end provided with a seat;

a foot rest support being mounted to a front of said secondary support and having two backward and outward extended foot rests for a user to rest two feet or apply a forward force thereon: and a short and a long link, said short link being pivotally connected at an upper end to said foot rest support and at a lower end to a front portion of said seat holder, said long link being pivotally connected at an upper end to one of said adjusting hole pairs of said pull member and at a lower end to said front portion of said seat holder behind said short link;

whereby said main and said secondary supports, said two links, said pull member, said handle bar, and said foot rest support together form a linkage and leverage.

* * * * *